US007730955B2

(12) United States Patent
Farquhar et al.

(10) Patent No.: US 7,730,955 B2
(45) Date of Patent: Jun. 8, 2010

(54) GROOVED EXPANDABLE RECESS SHOE AND PIPE FOR DEPLOYMENT OF MECHANICAL POSITIONING DEVICES

(75) Inventors: Graham E. Farquhar, Aberdeenshire (GB); Mark K. Adam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 22 days.

(21) Appl. No.: 12/133,972

(22) Filed: Jun. 5, 2008

(65) Prior Publication Data

US 2008/0302541 A1 Dec. 11, 2008

Related U.S. Application Data

(60) Provisional application No. 60/933,470, filed on Jun. 6, 2007.

(51) Int. Cl.
*E21B 19/16* (2006.01)

(52) U.S. Cl. ..... 166/380

(58) Field of Classification Search ..... 175/380, 175/384, 207; 166/380, 384, 207
See application file for complete search history.

(56) References Cited

U.S. PATENT DOCUMENTS

| | | | | |
|---|---|---|---|---|
| 6,457,532 | B1 * | 10/2002 | Simpson | 166/380 |
| 6,843,322 | B2 * | 1/2005 | Burtner et al. | 166/382 |
| 7,140,444 | B2 * | 11/2006 | Mackay | 166/380 |
| 7,410,001 | B2 * | 8/2008 | Harrall et al. | 166/380 |

OTHER PUBLICATIONS

Walvekar et al., "Expandable Technology Improves Reliability of Conventional Liner Hanger Systems," IADC/SPE 99186, Feb. 2006, 11 pages.
Norton et al., "Wind Tunnel Tests of Inclined Circular Cylinders," *Society of Petroleum Engineers Journal*, Feb. 1983, pp. 191-196.

* cited by examiner

*Primary Examiner*—William P Neuder
(74) *Attorney, Agent, or Firm*—Shawn Hunter

(57) ABSTRACT

A first, expandable casing member, in an unexpanded state, is provided with a lower axial end that has a radially expanded upset or recess shoe and a locating profile. The first casing member is run into a wellbore, expanded, and secured in place within the wellbore. A second expandable casing member is then provided in an unexpanded state and disposed into the wellbore through the first casing member using a running tool. The second casing member is located with respect to the first casing member and expanded using an expansion member carried by the running tool.

16 Claims, 4 Drawing Sheets

GROOVED EXPANDABLE RECESS SHOE AND PIPE FOR DEPLOYMENT OF MECHANICAL POSITIONING DEVICES

CROSS-REFERENCE TO RELATED APPLICATIONS

This application claims the priority of U.S. Provisional Patent Application Ser. No. 60/933,470 filed Jun. 6, 2007.

BACKGROUND OF THE INVENTION

1. Field of the Invention

The invention provides devices and methods for casing a drilled bore. In particular aspects, the invention relates to wellbore casings that are formed using expandable tubing.

2. Description of the Related Art

Following drilling, a wellbore is typically lined with a casing in order to prevent the borehole from collapsing and to prevent undesirable fluid migration through the borehole wall. Often, a wellbore is drilled in successively deeper intervals. As a result, the lower intervals are cased with strings of casing having successively smaller diameters. Since the casing sections for the lower intervals must be able to pass through the interior diameter of the upper intervals. This places significant size limitations on the wellbore at significant depths.

Recently, processes have been developed for the use of casing members that are radially plastically-expandable. This permits the lower intervals of the wellbore to have the same diameter as the casing sections above. An example of such systems is the LinEXX system, which is available commercially from Baker Hughes Incorporated in Houston, Tex. The lower casing member is disposed through the upper casing member in a radially collapsed state. Then, an expansion member, such as a swage, is used to expand the lower casing member radially. Thereafter, the lower casing member may be cemented into place within the wellbore. Alternatively, open hole packers can be utilized on the exterior of the expanded tubular to perform the required zonal isolation functionality. In addition, the lower casing member must be joined to the upper casing member so that a continuous lining of the borehole is created. Ordinarily, this is done by forming an expanded diameter upset, or recess, in the lower end of the upper casing member. Then the upper end of the lower casing member is located within the recess.

In expandable casing systems, the ability to locate the lower casing member with respect to the upper casing member within the wellbore is critical to proper construction of the casing string. FIG. 1 illustrates a situation wherein the upper end 10 of the lower casing member 12 is too high within the wellbore with respect to the upper casing member 14. As a result, the upper end 10 of the lower casing member 12 lies above the recess 16 that has been formed in the upper casing member 14. Upon expansion of the lower casing member 12, the upper end 10 will not be fully expanded due to the restriction provided by the upper casing member 14. This results in a restricted diameter blockage 18 within the casing string.

FIG. 2 depicts an alternative situation in which the upper and lower casing members 14, 12 are improperly located with respect to each other. In this instance, the lower casing member 12 is located too far below the upper casing member 14. As a result, the upper end 10 of the lower casing member 12 does not reside within the recess 16, and there is an undesirable break in the string of casing.

In prior art systems, the recess is formed in the upper casing member in a separate step before the lower casing member is run-in and expanded. The recess is typically formed using a rotary expansion tool. At the same time that the recess is formed, a locating profile may be formed into the upper casing member as well.

A significant problem associated with many contemporary expandable casing systems is that an extra trip into the wellbore is needed to create the recess in the upper casing member following the primary diametrical expansion of the upper casing member. This entails significant time and cost. In addition, conventional locating devices are not generally sufficient to locate a lower casing member with respect to an upper casing member. Existing methods are limited (e.g., run to bottom of hole, then space out from bottom or run below the shoe then space out from the bottom of the shoe) and all require running deeper than necessary. Furthermore, conventional methods are problematic with regard to getting stuck on bottom or getting stuck pulling back from an open hole into a cased hole.

SUMMARY OF THE INVENTION

The invention provides a system and method for casing a wellbore using expandable casing members. An exemplary system is described wherein radially-expandable casing members are provided initially in an unexpanded condition. In the unexpanded condition, a portion of the tubular capable of being formed into a recess or upset ID (interior diameter) is placed into a first casing member proximate one axial end. In addition, a locating profile is formed or machined into the first casing member proximate the same axial end as the recess capable portion. Once the first casing member has been disposed into the wellbore to a desired location, it is radially expanded using an expansion member, such as a swage. Following expansion of the first casing member, the recess capable portion is further expanded into a larger diameter recess and the expanded locating profile remains usable. A second casing member can be run into the wellbore on a running tool and located with respect to the first casing member such that, when expanded, the upper end of a lower casing member will properly reside within the recess of the upper casing member immediately above it. A suitable locating member on the running tool string will engage the locating profile within the first casing member, thereby locating the upper end of the second casing member within the recess shoe formed at the axial end of the first casing member.

According to an exemplary method of the present invention, a first, expandable tubular casing member, in an unexpanded state, is provided with a lower axial end that has a radially expanded upset or recess shoe and a locating profile. Thereafter, the first tubular casing member is run into a wellbore, expanded, and secured in place within the wellbore. A second expandable casing member is then provided in an unexpanded state and disposed into the wellbore through the first casing member using a running tool. A locating member on the run-in tool engages the locating profile on the first casing member to locate the second casing member with respect to the first casing member. Thereafter, the second casing member is expanded radially, causing the upper end of the second casing member to be expanded within the recess formed in the upper casing member. The second casing member can then be cemented into place. Alternatively, open hole packers could be utilized on the exterior of the expanded tubular to perform zonal isolation.

BRIEF DESCRIPTION OF THE DRAWINGS

The structure and operation of the invention will be more readily understood with reference to the following drawings, which are illustrative thereof and among which like components are numbered with like reference numerals.

DETAILED DESCRIPTION OF THE PREFERRED EMBODIMENTS

Figure 3:
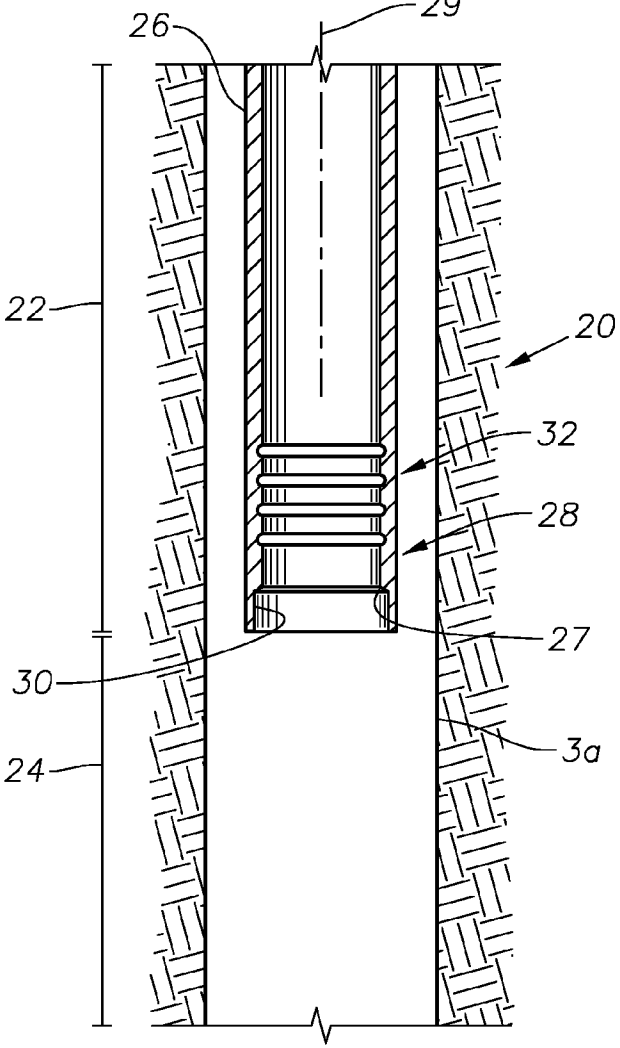
FIG. 3 is a side, cross-sectional view of a portion of an exemplary wellbore with unlined upper and lower intervals, and a first expandable casing member being disposed into the upper interval.
Figure 2:
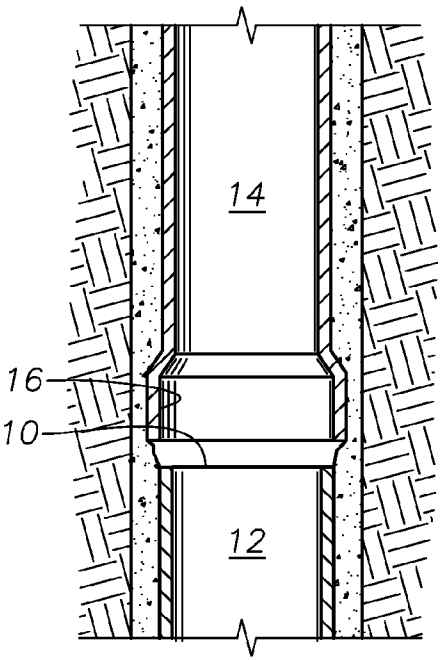
FIG. 2 is a side, cross-sectional view of an exemplary wellbore having improperly located casing members.
Figure 1:
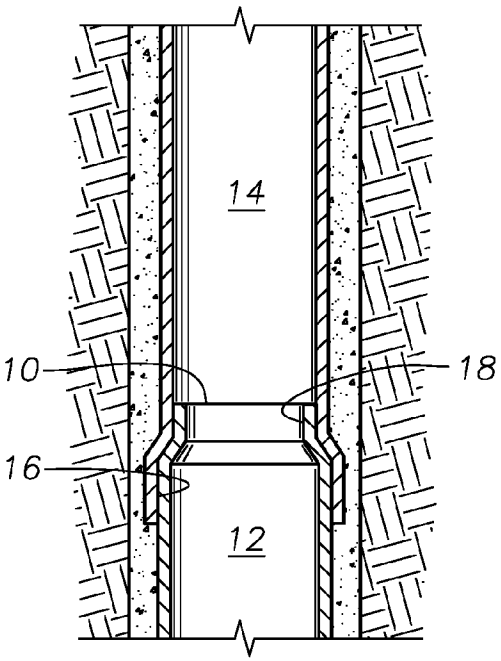
FIG. 1 is a side, cross-sectional view of an exemplary wellbore having improperly located casing members.

FIGS. 3-7 schematically illustrate a portion of an exemplary wellbore 20 having an upper interval 22 and a lower interval 24. As FIG. 3 illustrates, a first casing member 26 is disposed into the upper interval 22 in an unexpanded condition. It is noted that the lower end 28 of the first casing member 26 includes an increased diameter upset, or recess shoe 30. In addition, a locating profile 32 is formed in the first casing member 26 proximate the lower end 28. It is noted that both the recess shoe 30 and the locating profile 32 have been formed within the flowbore 36 of the first casing member 26 prior to running the member 26 into the wellbore 20. It is further noted that the recess shoe 30 and locating profile 32 were formed while the first casing member 26 is in an unexpanded condition. The locating profile 32 is formed to have suitable depth within the casing member 26 so that it will not be eliminated during the general expansion of the casing member 26.

Figure 3A:
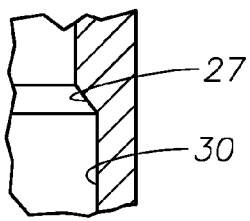
Figure 4:
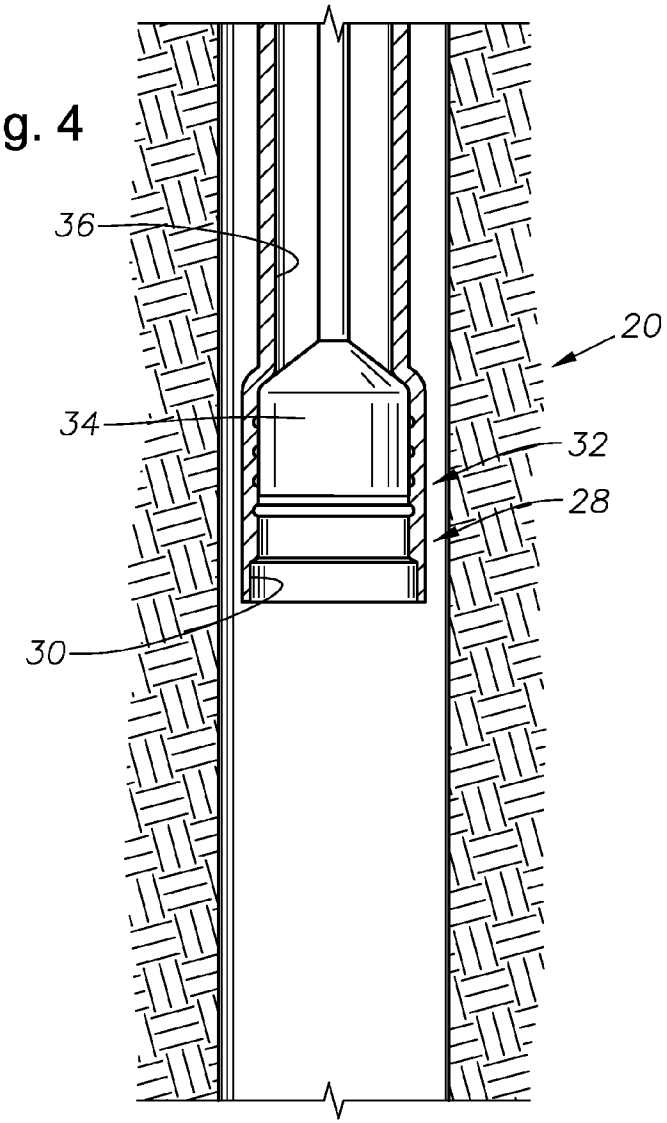
FIG. 4 is a side, cross-sectional view of the wellbore portion shown in FIG. 3, now with the first casing member being radially expanded.

To install the first casing member 26 within the wellbore 20, an expansion member, shown schematically at 34 in FIG. 4 is moved through the interior flowbore 36 of the first casing member 26. In FIG. 4, the expansion member 34 is depicted as moving upwardly from below the first casing member 26. However, the invention also contemplates the use of a swaging device that moves from the upper end of the first casing member 26 downwardly through the tubular 26. It is noted that a single diameter swage can be used for the expansion member 34. Swages and similar expansion tools are well known in the art. It is noted that the expansion member 34 will radially expand the first casing member 26 so that the casing member 26 is moved from an unexpanded condition to an expanded condition wherein the interior and exterior diameter of the casing member 26 are plastically deformed and are both larger than in the unexpanded condition. It is noted that, following expansion by the expansion member 34, the recess shoe 30 provides an internal diameter that is large enough to receive the external diameter of another expanded casing member. The interior diameter of the recess shoe 30 is larger than the interior diameter of the flowbore of the casing member 26 above it. The recess 30 can be profiled in a tapered form or be separated from the general flowbore of the casing member 26 by a radial shoulder. The latter shoulder is an alteration in the interior geometry of the flowbore that can be detected during swaging. Contact between the swaging tool and the shoulder can provide a "pressure signature" at surface that informs the operator of the exact stage of the swaging process. A transition bevel between the flowbore and the recess 30 would be provided by a sloped shoulder 27 that separates the flowbore 36 from the recess 30. In a currently preferred embodiment, the shoulder 27 departs at an approximate 30 degree angle from the longitudinal axis 29 of the first casing member 26. FIG. 3*a* illustrates a preferred shoulder 27. The shoulder 27 is sloped in this manner rather than squared off in order to allow the expansion member 34 to pass by the shoulder 27 without becoming hung up on it.

Figure 5:
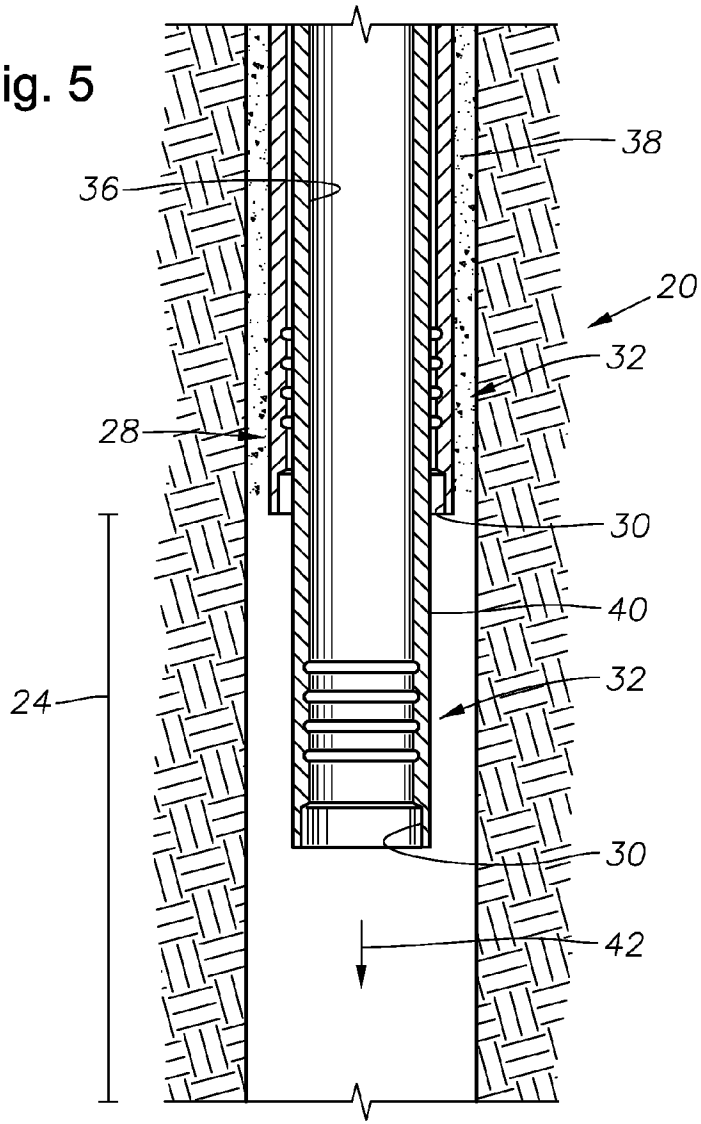
FIG. 5 is a side, cross-sectional view of the wellbore portion shown in FIGS. 3 and 4 now with a second casing member being disposed into the lower interval.

Turning now to FIG. 5, the first casing member 26 has now been fully radially expanded by the expansion member 34 and has been secured within the wellbore 20 by cement 38, in a manner that is known in the art. At this point, the lower interval 24 is uncased. However, a second expandable casing member 40 is being disposed through the flowbore 36 of the first casing member 26, in the direction of arrow 42, in order to be disposed into the lower interval 24 of the wellbore 20. During this operation, the second casing member 40 is in a radially unexpanded condition. It is noted that the second casing member 40 preferably also includes a recess 30 and a landing profile 32 at its lower axial end, in the same manner as the first casing member 26, so that in the event that a deeper well interval must be drilled and then cased, the effort required will not be significant.

Figure 6:
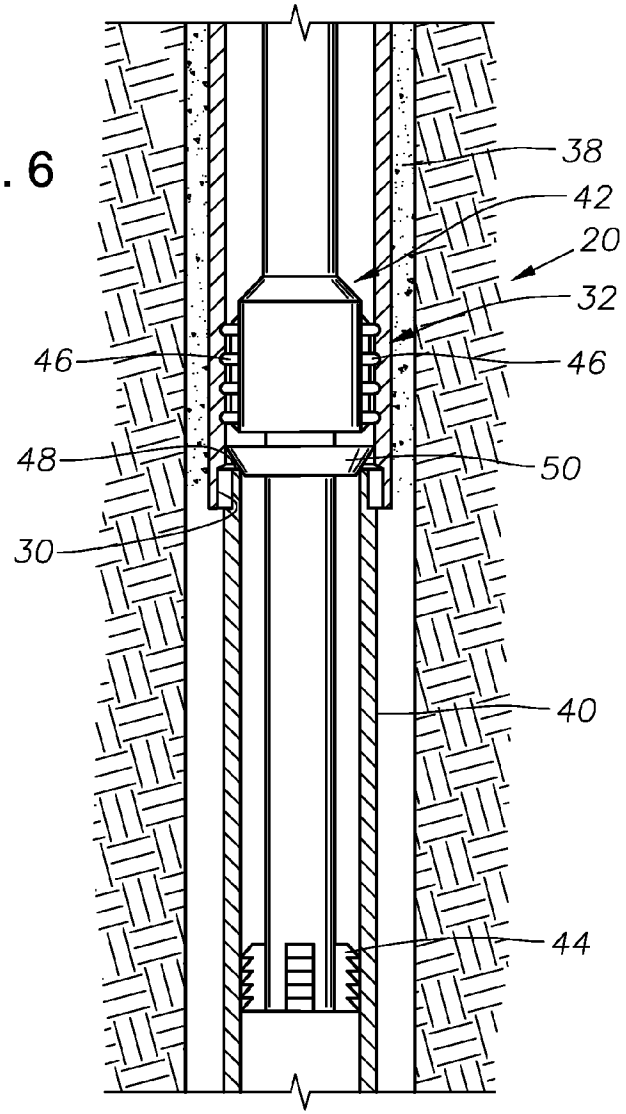
FIG. 6 is a side, cross-sectional view of the wellbore portion shown in FIGS. 3-5 now with the second casing member being located with respect to the first casing member.

As FIG. 6 depicts, the second casing member 40 is run into the wellbore 20 by a running tool 42 which serves to both support the second casing member 40 and to locate it with respect to the first casing member 26. A suitable running tool for use in this application is a catEXX™ hydraulic expansion system, which is available commercially from Baker Hughes Incorporated of Houston, Tex. and which has been modified in accordance with the present invention. The running tool 42 includes a running string and further includes a set of locking slips 44 that are carried by the running string. The locking slips 44 releasably secure the second casing member 40 to the running tool 42. Locking slips are a known mechanism wherein a one or more toothed slip members are selectively moveable radially outwardly to form a biting engagement with the surface of a surrounding tubular member. In addition, the running tool 42 includes a set of locating members 46 which are carried by the running string and shaped and sized to reside within the locating profile 32 in a complimentary manner. When the locating members 46 of the running tool 42 are latched within the locating profile 32 of the first casing member 26, the upper end 48 of the second casing member 40 will be aligned with the recess shoe 30 of the first casing member 26. The locating profile 32 in the first casing member 26 is located at a distance from the recess shoe 30 such that the upper end 54 of the second casing member 40 will be located very close to the shoulder 27, as this proximate location increases the collapse rating of the recess shoe 30. Also, the running tool 42 includes an expansion member 50 that is moveable with respect to the locking slips 44 and the locating members 46.

Figure 7:
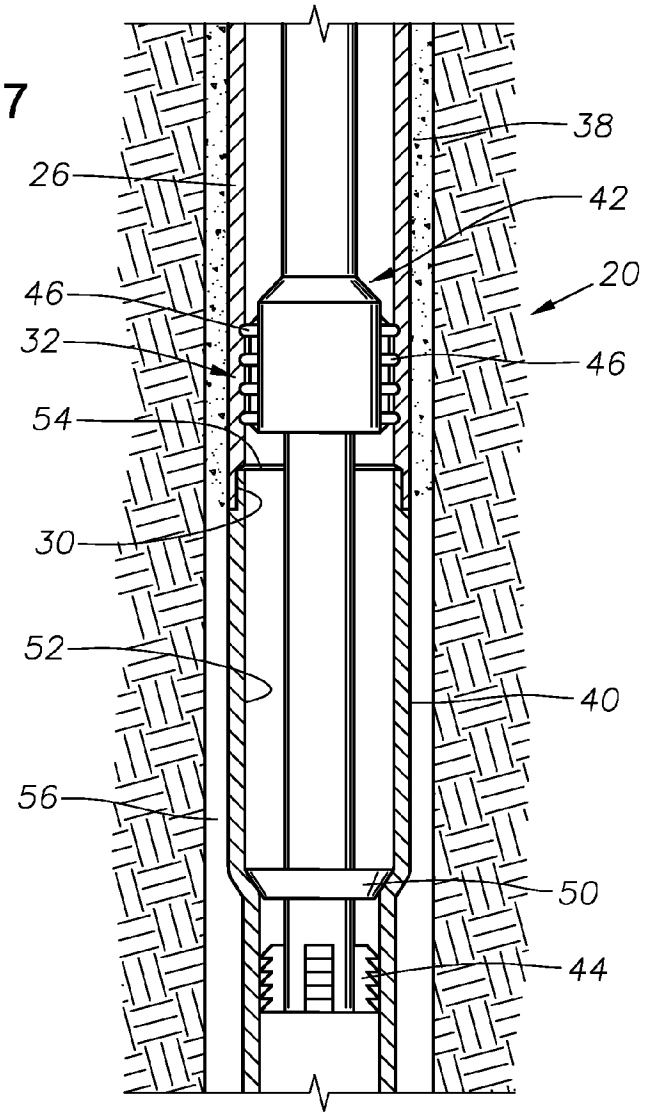
FIG. 7 is a side, cross-sectional view of the wellbore portion shown in FIGS. 3-6 now with the second casing member being radially expanded.

FIG. 7 shows the expansion member 50 being moved downwardly through the flowbore 52 of the second casing member 40. As this occurs, the second casing member 40 is radially expanded outwardly. The upper end 54 of the second casing member 40 will reside within the recess 30 of the first casing member 26. If desired, an expandable hanger member (not shown) may be positioned around the outer radial surface of the upper end 54 of the second casing member 40 to help secure the first and second casing members 26, 40 to one another. After the second casing member 40 has been radially expanded, the running tool 42 can be released from the second casing member 40 and removed from the wellbore 20. Cement can then be circulated into the annulus 56 surrounding the second casing member 40 to secure it in place within the wellbore 20.

Figure 8:
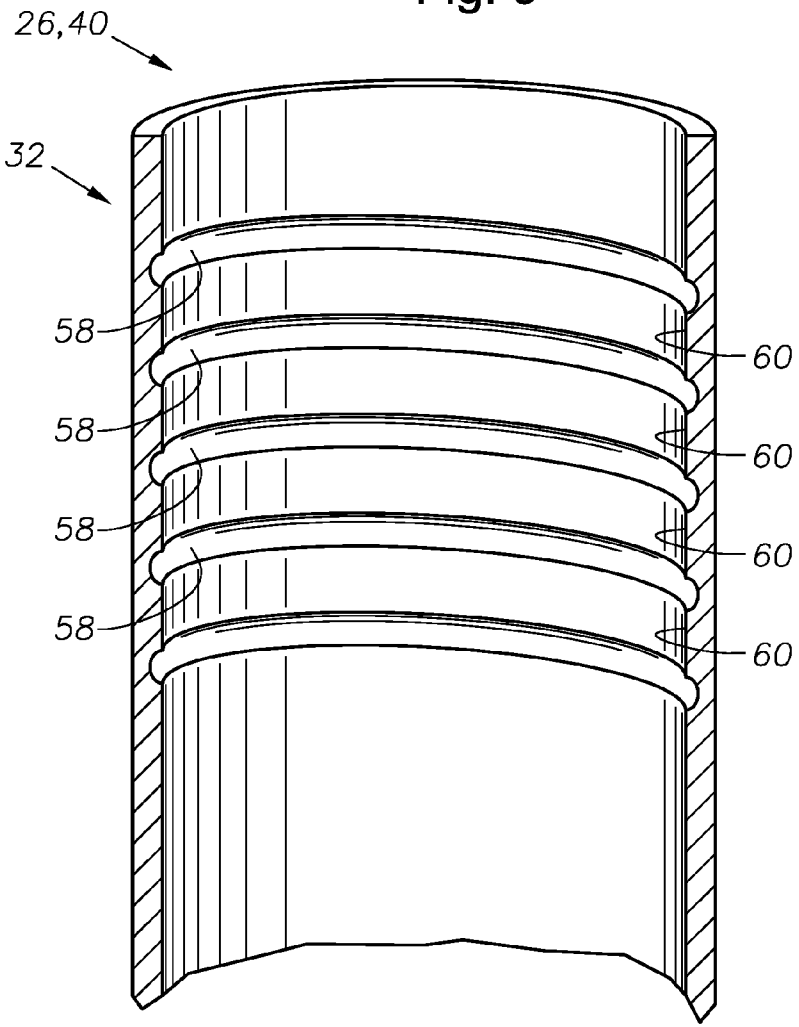
FIG. 8 illustrates an exemplary locating profile used with the system depicted in FIGS. 3-7.

Details of an exemplary locating profile 32 are more clearly depicted in FIG. 8. As shown, the locating profile 32 is made up of a series of annular grooves 58 separated by annular ridges 60. Because the grooves 58 change shape following expansion of the casing member they are formed in, they should be designed to suit the altered geometry. To provide sufficient load bearing capacity, a series of multiple grooves 58 is preferred. In addition, the grooves 58 provide a unique pressure signature during swaging to verify depth. In addition, the presence of the grooves 58 can also provide a means for activating other tools when positioned at this known depth. In other words, in addition to their usefulness as locating devices, the locating profiles 32 could be used to position other completion tools or instruments at precise locations within the flowbore 36 of the casing string in order to conduct specific types of operations (i.e., setting a bridge plug to pressure test the casing string).

Figure 9:
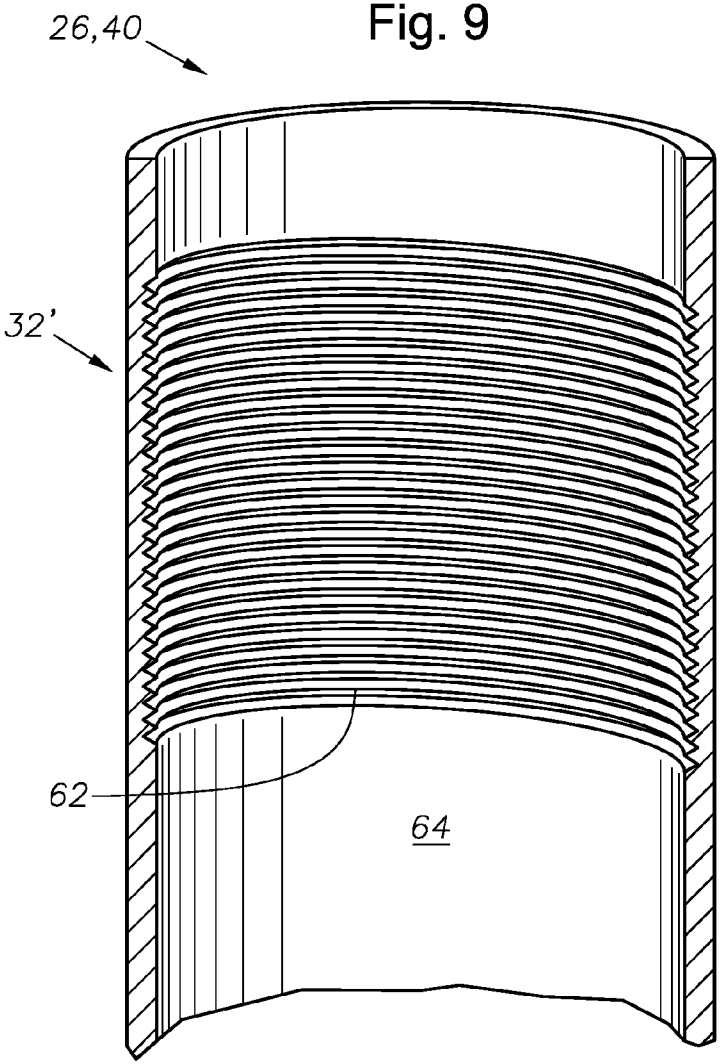
FIG. 9 depicts an alternative embodiment for a locating profile in accordance with the present invention.

FIG. 9 depicts and alternative embodiment for a locating profile 32' in accordance with the present invention. The locating profile 32' features a helical thread 62 that is formed into the interior wall 64 of the casing member 26, 40. In this embodiment, the locating member 46 of the run-in tool 42 would be shaped and sized to be generally complimentary to the threading.

Those of skill in the art will recognize that numerous modifications and changes may be made to the exemplary designs and embodiments described herein and that the invention is limited only by the claims that follow and any equivalents thereof.

What is claimed is:

1. A system for casing a wellbore comprising:

a first casing member having a generally cylindrical body that defines a central axial flowbore and that is plastically expandable between a radially unexpanded condition and a radially expanded condition, the casing member further having:

a recess shoe formed within the flowbore and having an expanded diameter with respect to the flowbore for seating of a second casing member;

a locating profile formed within the flowbore for seating of complimentary locating members; and a second casing member having a generally cylindrical body that defines a central axial flowbore and that is plastically expandable between a radially unexpanded condition and a radially expanded condition.

2. The system of claim 1 further comprising a running tool for disposing the second casing member into the wellbore, the running tool comprising:

a running string;

a securing mechanism carried by the running string for releasably securing the second casing member to the running tool;

a locating member that is generally complimentary to the locating profile for locating the second casing member with respect to the first casing member.

3. The system of claim 2 wherein the securing mechanism comprises a locking slip for engaging the running tool with the flowbore of the second casing member.

4. The system of claim 1 wherein the locating profile comprises an annular groove disposed within the flowbore.

5. The system of claim 1 wherein the locating profile comprises a plurality of annular grooves disposed within the flowbore, at least two of the annular grooves being separated by an annular ridge.

6. The system of claim 1 wherein the locating profile comprises a helical groove disposed within the flowbore.

7. The system of claim 2 wherein the running tool further comprises an expansion member carried by the running tool and moveable with respect to the locating member and moveable through the flowbore of the second casing member to radially expand the second casing member to its expanded condition.

8. A method of casing a wellbore with radially expandable casing members, the method comprising the steps of:

disposing a first casing member into a wellbore, the first casing member having a generally cylindrical body that defines a central axial flowbore and that is plastically expandable between a radially unexpanded condition and a radially expanded condition, the first casing member further being disposed into the wellbore in the unexpanded condition;

radially expanding the first casing member;

disposing a second casing member into the wellbore through the flowbore of the first casing member, the second casing member having a generally cylindrical body that defines a central axial flowbore and that is plastically expandable between a radially unexpanded condition and a radially expanded condition, the second casing member further being disposed into the wellbore in the unexpanded condition;

locating the second casing member with respect to the first casing member to align an axial end of the second casing member within a recess shoe of the first casing member by disposing a locating member associated with one of said casing members within a locating profile associated with the other of said casing members; and radially expanding the second casing member.

9. The method of claim 8 further comprising the step of releasably securing a running tool to the second casing member prior to disposing the second casing member into the wellbore.

10. The method of claim 8 wherein the step of radially expanding the first casing member comprises passing an expansion member through the flowbore of the first casing member to plastically expand the first casing member to its expanded condition.

11. The method of claim 8 wherein the step of radially expanding the second casing member comprises passing an expansion member through the flowbore of the second casing member to plastically expand the second casing member to its expanded condition.

12. The method of claim 8 further comprising the step of cementing the first casing member within the wellbore after the step of radially expanding the first casing member.

13. The method of claim 8 further comprising the step of releasing the running tool from the second casing member following the step of expanding the second casing member.

14. The method of claim 13 further comprising the step of cementing the second casing member within the wellbore.

15. A method of casing a wellbore with radially expandable casing members, the method comprising the steps of:

disposing a first casing member into a wellbore, the first casing member having a generally cylindrical body that defines a central axial flowbore and that is plastically expandable between a radially unexpanded condition and a radially expanded condition, the first casing member further being disposed into the wellbore in the unexpanded condition;

radially expanding the first casing member;

releasably securing a second casing member to a running tool, the second casing member having a generally cylindrical body that defines a central axial flowbore and that is plastically expandable between a radially unexpanded condition and a radially expanded condition, the second casing member further being disposed into the wellbore in the unexpanded condition;

disposing the running tool and second casing member into the wellbore through the flowbore of the first casing member;

locating the second casing member with respect to the first casing member to align an axial end of the second casing member within a recess shoe of the first casing member by disposing a locating member associated with one of said casing members within a locating profile associated with the other of said casing members; and radially expanding the second casing member.

16. The method of claim 15 wherein the second casing member is expanded by an expansion member carried on the running tool.

* * * * *